US007419561B1

(12) United States Patent
Omohundro

(10) Patent No.: US 7,419,561 B1
(45) Date of Patent: Sep. 2, 2008

(54) CAST COMPOSITE SAIL AND METHOD

(76) Inventor: Thomas Ward Omohundro, 1132 "C" Airport Rd., Minden, NV (US) 89423

( * ) Notice: Subject to any disclaimer, the term of this patent is extended or adjusted under 35 U.S.C. 154(b) by 355 days.

(21) Appl. No.: 11/110,987

(22) Filed: Apr. 18, 2005

Related U.S. Application Data

(62) Division of application No. 10/392,702, filed on Mar. 19, 2003, now Pat. No. 6,971,430.

(51) Int. Cl.
*B29C 47/00* (2006.01)

(52) U.S. Cl. ..... 156/246; 114/102.1; 114/102.31; 156/166

(58) Field of Classification Search ..... 114/102.1, 114/102.31; 156/242, 246, 166, 176, 177, 156/179
See application file for complete search history.

(56) References Cited

U.S. PATENT DOCUMENTS

| | | | | |
|---|---|---|---|---|
| 4,708,080 | A | 11/1987 | Conrad | 114/103 |
| 5,097,783 | A | 3/1992 | Linville | 114/103 |
| 5,097,784 | A | 3/1992 | Baudet | 114/103 |
| 5,355,820 | A | 10/1994 | Conrad et al. | 114/103 |
| 5,403,641 | A | 4/1995 | Linville et al. | 428/113 |
| 6,332,420 | B1 | 12/2001 | Rodgers | 114/102.31 |
| 6,382,120 | B1 | 5/2002 | Keire | 114/102.29 |
| 2006/0157189 | A1 | 7/2006 | Gautier et al. | |

FOREIGN PATENT DOCUMENTS

| | | | |
|---|---|---|---|
| WO | WO 03024779 | A2 * | 3/2003 |
| WO | 2004005009 | A1 | 1/2004 |

* cited by examiner

*Primary Examiner*—Jeff H Aftergut
*Assistant Examiner*—Daniel McNally
(74) *Attorney, Agent, or Firm*—Lewis and Roca LLP

(57) ABSTRACT

A method of casting a sail comprising supplying a carrier film, supporting the carrier film along a support mechanism, forming a sail form with the support mechanism, pulling the carrier film across the support mechanism, forming a first coating, wiping the resin to control resin amount for forming the first coating, applying a yarn on the first coating in a pattern, applying a yarn on the first coating in a second pattern, dispensing a resin onto the carrier film to form a second coating covering at least one of the first pattern and the second pattern, wiping the resin to control the resin amount for forming the second coating, applying an additional element to at least one of the first coating and the second coating, applying a top film on the second coating, calendering the first and second coating, and curing the resin of the first and second coating.

23 Claims, 14 Drawing Sheets

CAST COMPOSITE SAIL AND METHOD

CROSS-REFERENCE TO RELATED APPLICATIONS

This application is a divisional of co-pending U.S. patent application Ser. No. 10/392,702, filed Mar. 19, 2003, now U.S. Pat. No. 6,971,430 the entirety of which is incorporated by reference herein.

BACKGROUND

The present invention relates to sails and more particularly, to a process and apparatus for casting sails and the reinforced sails produced thereby.

Sails are three dimensional (solid rather than plane) surfaces. They are so to provide lift for the sailplan and therefore for the sailboat. Presently, substantially all sails are because of their size, traditionally, made of panels or sections which are arranged in one way or another, usually at the discretion of a sail designer.

When placed on a planar surface such as a floor and when in use and set upon the sailplan, most sails exhibit a distinct element of vertical camber throughout. The body of the sail performs three missions. First, it separates its high pressure side from its low pressure side. Second, it supports the sail s internal structure and retains its structural elements and members in the exact positions, which they are intended to occupy. Third, it provides the sail with the durability and resilience which is illustrated in a tendency to resist damage from tearing, from creasing and folding, from vibrating (luffing) in the wind, and from chafing against the sailplan s components such as mast, standing rigging and lifelines.

The current state of the sail manufacturing art results in a sail product whose body is a sandwich-type construction. Specifically, such sails are comprised of a skeletal structure of load-bearing fibers or yarns that is covered on each side by layers of polyester film, woven taffeta materials, or both. The outside layers are fastened to the internal skeletal yarn structure and to each other by the use of adhesives and/or by the application of heat and pressure in the manufacturing process. Sails employing the concepts of these patents are now employed widely and particularly by racing yachts.

Certain prior art sail manufacture includes a method of fabrication employing panels which are assembled and to which structural yarns are subsequently applied.

An alternate sail manufacture system includes a method for casting a sail from liquid synthetic resin using a mold comprised of numerous sections which can be altered in position to establish the desired sail contour. Obviously, the size of the sail that can be produced is limited by the size of the mold, and the costs of fabricating such a mold. Moreover, there is no reinforcement provided in such a cast structure. In another prior art system, a process for making a sail includes the use of panels assembled into a substrate and draped over a table configurable to the contours desired for the sail. Reinforcing yarns or fibers are laid onto the substrate in a pattern. This process involves costly and time consuming initial steps of precutting and then carefully assembling the panels to provide the substrate which will then assume the contours of the table.

What is needed in the art is a system that produces a casting of a seamless sail formed in one piece. The system should include the addition of reinforcing yarns in a pattern within a matrix of resin. The need exists for a low cost sail having desirable form and durability that can be rapidly produced.

SUMMARY

The disclosed device is directed towards an apparatus for casting sails comprising a roll stand configured to supply a carrier film. A support mechanism is operatively coupled to the roll stand and the support mechanism is configured to support the carrier film. The support mechanism forms a support surface for the carrier film, wherein the support surface forms a sail form. A drawing mechanism is operatively coupled to the roll stand. The drawing mechanism is configured to pull the carrier film along the support surface in a first direction. At least one first resin dispenser is located above the support surface. The at least one first resin dispenser is configured to dispense a resin on the carrier film forming a first coating on the carrier film. At least one first wiper portion is proximate to the at least one first resin dispenser. The at least one first wiper portion is configured to control the amount of resin forming the first coating. A first yarn applicator is proximate to the first wiper. The yarn applicator is configured to apply yarns on the first coating in at least one first pattern on the first coating. A second yarn applicator is proximate to the first yarn applicator and the second yarn applicator is configured to apply yarns on the first coating in at least one second pattern on the first coating. At least one second resin dispenser is located above the support surface and the at least one second resin dispenser is configured to dispense a resin over the at least one first pattern and the at least one second pattern forming a second coating on the carrier film. At least one second wiper portion is proximate to the at least one second resin dispenser and the at least one second wiper portion configured to control the amount of resin forming the second coating. A top film applicator is proximate to the second wiper portion and the top film applicator is configured to apply a top film on the second coating. An element applicator is between the at least one first resin dispenser and the top film applicator and the element applicator is configured to apply additional elements on the first coating. A calender is proximate to the top film applicator and the calender is configured to shape and degas the first coating and the second coating between the carrier film and the top film. At least one curing mechanism is proximate to the calender and the curing mechanism is configured to cure the first coating and the second coating of resin.

A method is disclosed for casting a sail. The method comprises supplying a carrier film, and supporting the carrier film along a support mechanism. The method includes forming a sail form with the support mechanism and pulling the carrier film across the support mechanism. The method includes dispensing a resin onto the carrier film to form a first coating and wiping the resin to control the amount of resin for forming the first coating. The method includes applying at least one yarn on the first coating in at least one first pattern and applying at least one yarn on the first coating in at least one second pattern. The method includes dispensing a resin onto the carrier film to form a second coating covering at least one of the first pattern and the second pattern. The method includes wiping the resin to control the amount of resin for forming the second coating and applying at least one additional element to at leapt one of the first coating and the second coating. The method includes applying a top film on the second coating and calendering the first coating and the second coating. The method includes curing the resin of the first coating and the second coating.

In another embodiment, the disclosed method is directed towards a flexible carrier being transported over a segmented support and a coating of liquid synthetic resin is deposited on the carrier in a predetermined pattern conforming substantially to the desired configuration for the sail.

The segments of the support are moved to shape the carrier and coating into the predetermined contour for the transverse portion of the sail disposed thereon concurrently with passage of the carrier thereover. The segments are formed progressively over the length of the support to conform with the predetermined contours of the sail being fabricated and passing thereover.

Structural yarns are deposited on the coating in a predetermined pattern, and additional liquid synthetic resin is applied to provide the desired depth for the coating corresponding substantially to the desired thickness for the sail and to encapsulate the structural yarns.

The resin is at least partially cured on the carrier to produce a composite sail body or structure having the desired configuration and contours with the structural yarns being embedded in the at least partially cured resin. The composite sail structure is removed from the carrier and the sail structure is trimmed to conform to the desired tri-cornered sail.

Preferably, the resin is initially deposited on the carrier as it is being transported in a width corresponding substantially to the predetermined foot of the sail, and thereafter the width of the liquid synthetic resin coating being deposited on the carrier is gradually reduced until deposition is terminated at the predetermined head of the sail.

Desirably, the deposited resin coating is smoothed to a desired thickness before the step of depositing the structural yarns thereon.

Generally, the carrier is formed by the segments to the desired transverse curvature prior to the smoothing step and the smoothing is effected by a wiper having a curvature conforming to the predetermined transverse curvature of the sail at the location of the wiper. Desirably, the step of depositing the structural yarns includes wiping the structural yarns onto the coating, and some of the structural yarns extend from the clew to the head of the sail. Preferably, some of the structural yarns extend from the clew to a multiplicity of points along the luff edge of the sail. In exemplary embodiments, the structural yarns can extend from the tack to the head, from the tack to the clew and the tack to the leech or luff edges.

In the preferred process, reinforcing yarns are deposited in the coating prior to the step of depositing structural yarns in the coating, and these reinforcing yarns generally extend transversely between the leech and luff. Desirably, the reinforcing yarns are angularly oriented relative to the horizontal.

Depending upon the length of the foot of the sail and the available width of the carrier film, the width of the carrier will generally be comprised of overlapping strips.

Preferably, the step of initiating at least a partial cure of the resin includes exposing the resin of the coating to ultraviolet radiation. Generally, a flexible top film is applied over the coating and is applied on the surface of the top film. Thereafter, the assembly of the films and coating is calendared prior to the curing step. After the curing step, the assembly of films and coating is removed from the support. If not fully cured, the resin is allowed to cure completely prior to removal of the carrier and top films from the sail structure and prior to the trimming step.

Additional elements are applied to the sail structure during the casting process. In larger headsails, one of the additional elements is reinforcing panel applied and formed during casting along the foot of the sail, and this panel includes reinforcing yarns arching between the tack and clew. For mainsails, additional elements include reinforcing strips applied and bonded at the desired locations for reef points and in which apertures are cut and grommets bonded thereto.

To preclude propagation of tears, the method may include a step of depositing and embedding small fibers in the coating.

If the resin is not completely cured when removed from the support, the assembly of films and coating may be hung in an appropriate fashion for a period of time to ensure complete curing of the resin of the coating.

The sail making apparatus includes roll support means for supporting at least one roll of carrier film, and a segmented support comprised of a multiplicity of movable segments, which provide a planar support surface and are movable to provide a transversely curved support surface. Drive means is provided to move the segments in accordance with predetermined movements to generate the desired transverse curvature in the carrier film passing thereover. Carrier film pulling means unrolls the carrier film and moving it onto and over the length of the elongated support in a machine direction, drive means controls the motion of the pulling means. Liquid resin dispensing means is provided above the support for dispensing liquid resin to provide a coating of liquid resin on the carrier film in a predetermined width, which is variable to reflect the intended transverse dimension of the body of the sail being cast on the carrier film as it moves thereby.

Transverse yarn laying means above the support lays synthetic resin yarns into the resin coating, and the laying means being movable generally transversely of the support. Structural yarn laying means is provided above the support for laying into the resin coating a multiplicity of yarns in a predetermined pattern extending generally in the machine direction. Second liquid resin dispensing means above the support dispenses liquid resin onto the coating to provide a predetermined thickness for the coating and to fully encapsulate the yarns. Top film applying means applies a top film over the coating and yarns, and thereafter a calendering means calenders the assembly of films, coating and yarns. Curing means then applies energy to the resin of the coating to effect at least partial curing thereof.

The transverse yarn laying means presses the transverse yarns into the coating, and the structural yarns laying means wipes the structural yarns onto the coating.

Similarly, the calendering means is configurable to conform to the curvature of the support thereunder. The structural yarn laying means is movable transversely of the support.

The resultant cast tri-cornered sail has a foot including a clew and a tack, a head opposite the foot as well as luff and leech edges extending between the head and the foot. The sail includes an integrally formed, seamless cast body with substantially smooth surfaces, and the body has a synthetic resin matrix in which are embedded structural yarns extending from the clew to the head and to the luff edge and extending from the tack to head as well as to the leech and clew and combinations thereof.

Preferably, the synthetic resin of the matrix is a thermosetting resin and the structural yarns are fabricated from a high modulus resin. A multiplicity of reinforcing yarns extending generally transversely from luff to leech, and the reinforcing yarns are angularly oriented relative to the edges of the sail. The reinforcing yarns overlap and cross over the structural yarns in a pattern to provide the necessary structural integrity. Reinforcing elements are formed in the body at the head and the foot of the sail. Luff tape is formed in the body along the luff and alternatively bonded to the body. Reef joints are generally provided by a reinforcing strip extending across the body from leech to luff and the reef points are disposed therein. In large sails, a reinforcing panel is bonded to the body and extends across the foot. This panel having structural yarns embedded therein and extending between the tack and clew.

As can be readily understood, the substance or body of the sail itself is made from a plastic resin. The internal stress distribution skeletal structure of yarns is made either from a material of moderate modulus, such as polyester or PENTEX (WHO), or from a material of relatively high modulus, such as TWARON, an aramid fiber such as KEVLAR, (VECTRAN), SPECTRA carbon and/or graphite fiber.

The system that inhibits tear proliferation is most often made from yarns of materials of moderate modulus, such as polyester, because of what can be termed the gauze-effect. Such materials, when stressed directly, immediately collect upon each other and hence possess an ability to arrest an incipient catastrophic tearing or ripping.

Components such as additional reinforcing of corners are made along with the body from plastic resin and materials common to the internal stress distribution structure itself. Compression members, such as a batten, can be initially made from a glass fiber and epoxy combination and in alternative methods made from the same materials as the body.

The sail is constructed in such a way that by the use of resins, an ever-changing computer driven form, and a process of continuous motion, a structural sail without panels is created. In addition, during this process, the internal structure is put in place, and a solid or three dimensional definition is applied to the sail. All of the sail s basic elements are created within it simultaneously. The entire sail is constructed from its basic material elements—plastic resins and high modulus fibers—in one continuous and computer driven process. The elapsed time of this process as it relates to a single sail from the inputting of a specification to absolute completion, is a mere fraction of that illustrated by current sail manufacturing processes and technologies.

Additionally, the sail is constructed in such a way that it (or, more specifically, its body) is completely devoid of panels or sections of any sort. The sail is constructed in such a way that it has a structural load-bearing system, applied without the use of adhesives and without the layering of films, taffetas, and the like, which is encapsulated in the sail s skin. The structural system is completely and totally encapsulated in the sail body, which itself is, from side-to-side (or top to bottom), without layers. Only the primary load-bearing system and yarns, which inhibit tearing, lie inside it. However, they are literally in it rather than sandwiched between layers of it. The sail is constructed In such a way as the sail body can be tapered from back to front (or from leech to luff). Such specific alteration of the thickness of the sail body within a sail can be advantageous, as often and the back of the sail (the leech) is subjected to far more abuse, wear and tear, and dynamic loads than is the front of the sail (the luff).

BRIEF DESCRIPTION OF THE ATTACHED DRAWINGS

DETAILED DESCRIPTION

The manufacturing process utilizes software which, from the taking of the order and the subsequent input of a very few independent variables, creates and defines all the elements of a specific sail—the profile, the three dimensional character, the substance of the sail body, the nature of the load bearing structure, and the definitions and placements of the sail s details. Such software is currently used to enable the assembling of panels to produce sail structures. Such software is modified and augmented in the process to control the operation of various pumps and motors to produce the entire sail body in a continuous casting operation that is described in detail hereinafter.

The production line and the initial machine and machine related components which comprise the machine comprises sizing the width of the largest sail intended to be fabricated thereby. For convenience, the width of a versatile installation is established as approximately thirty-five (35) feet for sails of moderate and moderately large sizes and is essentially equal in length to the foot lengths of the larger sails placed in production. For the specific production of smaller sails, the machine s width can be somewhat smaller and for very large sails the size can exceed thirty-five (35) feet. The sail is constructed by the production line in a foot (or bottom) first attitude.

Figure 1:
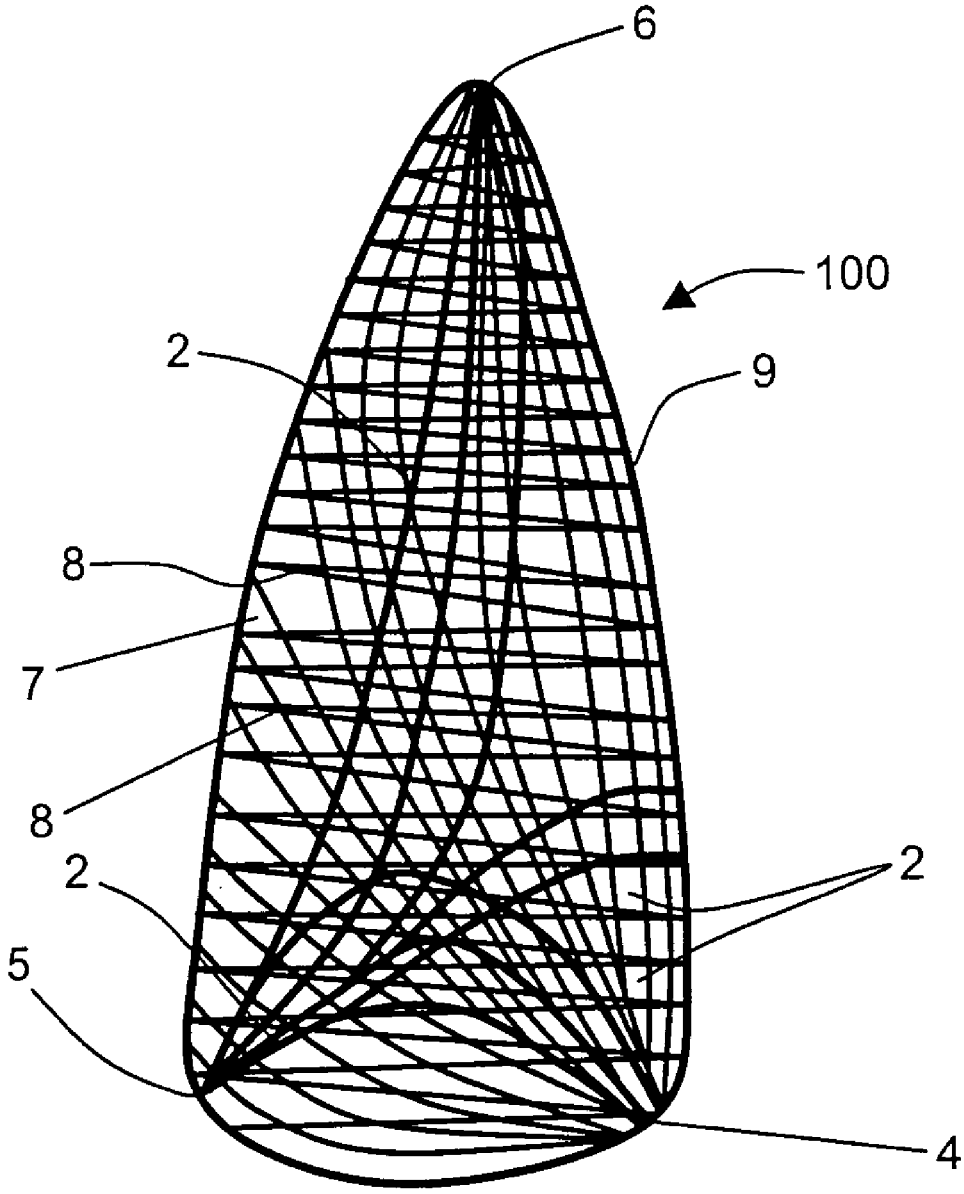
FIG. 1 is an elevational view of an exemplary jib sail fabricated in accordance with the exemplary process and utilizing an exemplary preferred skeletal structure of transverse yarns and structural yarns.

Turning first to FIG. 1, there illustrated is an exemplary jib sail made having structural yarns 2 emanating at the clew 4 and extending upwardly to the head 6 and to various points along the luff 7—Diagonal reinforcing yarns 8 extend angularly between the leech 9 and the luff 7. In an exemplary embodiment, the structural yarns 2 can extend from the tack 5 to the head 6 and to various points along the leech 9. Also in other embodiments the structural yarns 2 can extend from the tack 5 to the clew 4.

Figure 2:
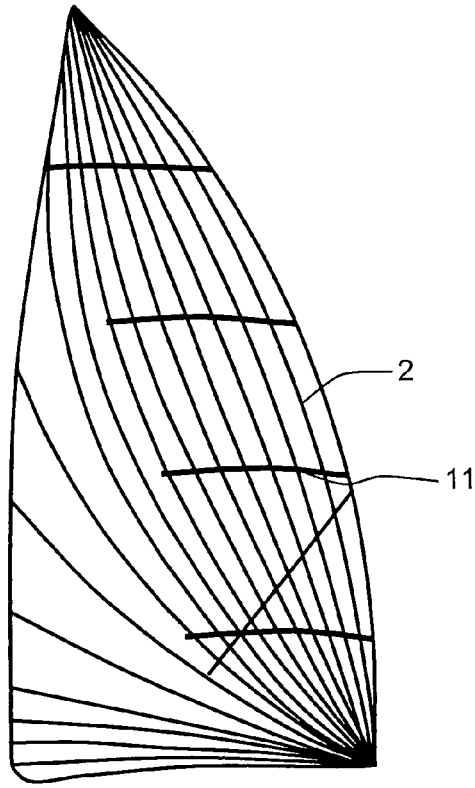
FIG. 2 is an elevational view of an exemplary mainsail fabricated in accordance with the exemplary process.

FIG. 2 illustrates an exemplary head sail with the structural yarns 2 depicted and having batten pockets 11.

Figure 3:
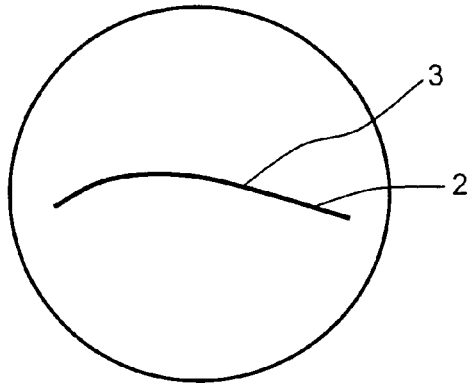
FIG. 3 is a fragmentary cross sectional view to an enlarged scale showing the three dimensional character of an exemplary sail and the structural yarns encapsulated therein.

FIG. 3 is an enlarged fragmentary section showing structural yarns 2 embodied in the resin matrix 3.

Figure 4:
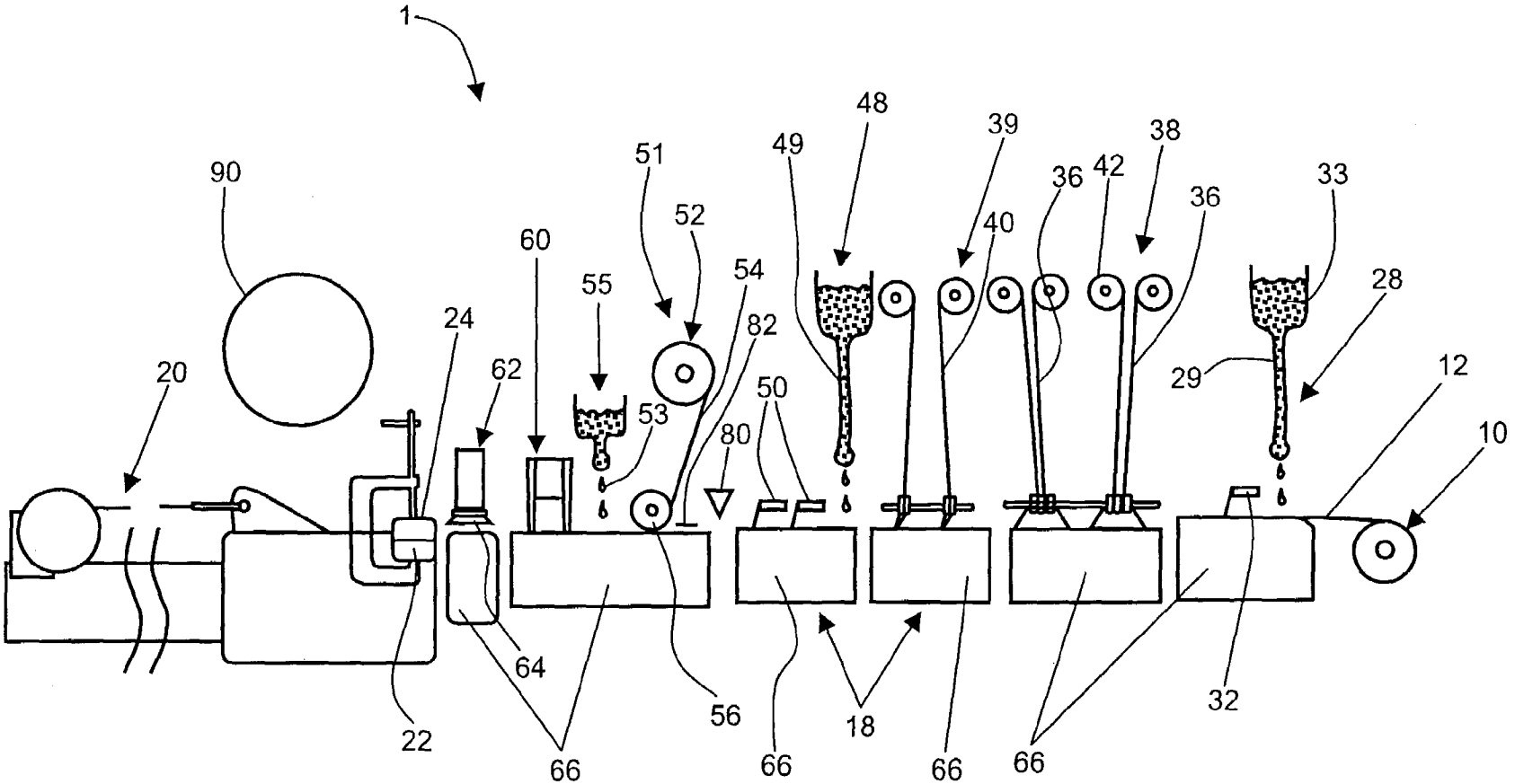
FIG. 4 is a schematic illustration of an exemplary installation for practicing the exemplary process to produce a seamless sail body.

Turning next to FIG. 4 of the attached drawings, therein illustrated schematically is a casting installation or simply a sail making apparatus 1. The first station within the sail making apparatus 1 is an unwind array or simply a roll stand generally designated by the numeral 10 from which sections of plastic film 12, each approximately seven (7) feet in width, are let-off.

Figure 5:
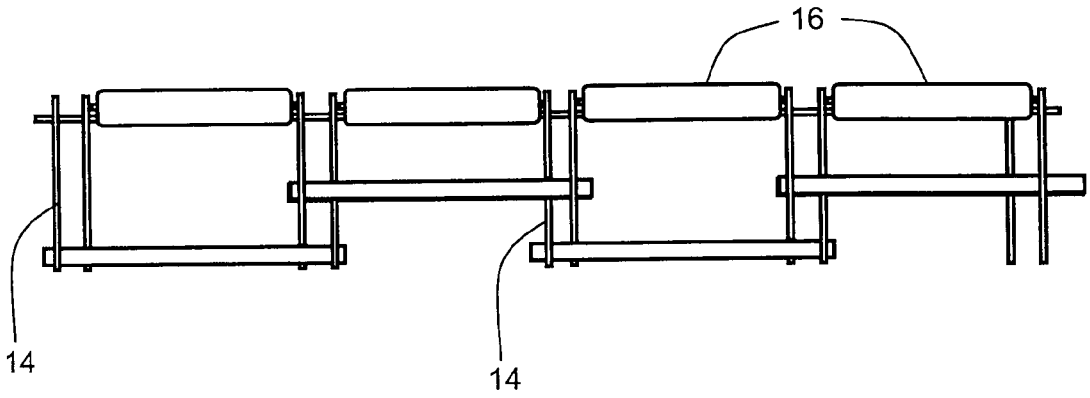
FIG. 5 is a front elevational view of an exemplary array of roll stands providing an exemplary unwind assembly for the carrier film.

As seen in FIG. 5, the roll stand (unwind) is separated into four individual unwinds or roll stands 14 each supporting a roll 16 of film. These individual roll stands 14 are placed one behind the other in a machine direction so that the edges of adjacent rolls 16 of film overlap each other in amounts of approximately three (3) inches. The number of rolls and roll stands 14 employed depends upon the maximum width (the foot length) of the specific sail in production. This film is a carrier that will transport the plastic sail body through the continuous flow process.

The installation includes a series of supports forming a support mechanism having a support surface and generally designated by the numeral 18 providing a platform over which the carrier film 12 passes. The support mechanism and support surface provide a sail form from which the shape of the sail to be cast is made. The support mechanism 18 can support a series of stations therealong at which various operations are performed as will be described hereinafter.

Figure 6:
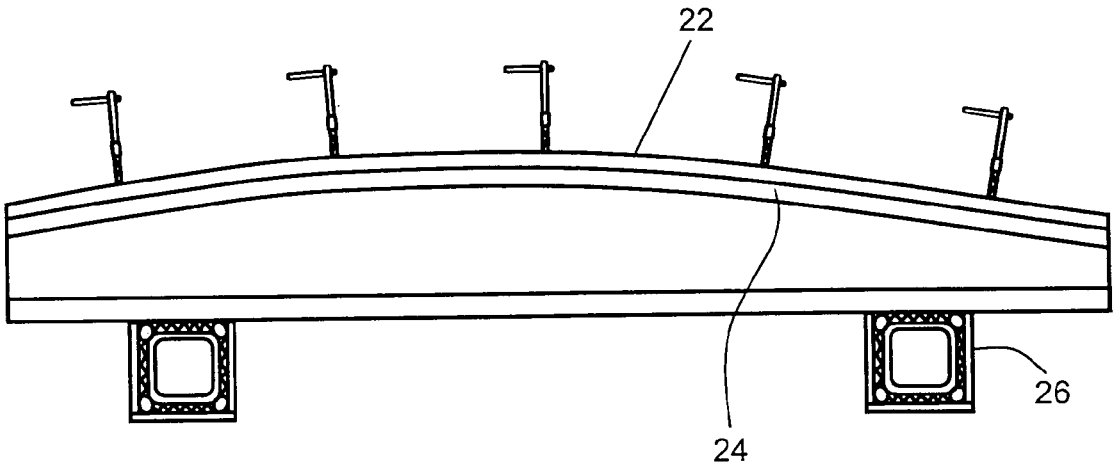
FIG. 6 is a front elevational view of the exemplary clamping mechanism for drawing the carrier films.
Figure 7:
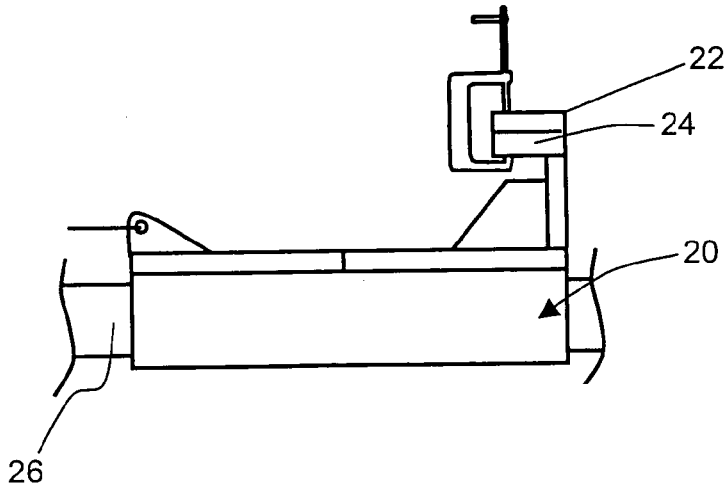
FIG. 7 is a side elevational view of the elements of FIG. 6.
Figure 18:
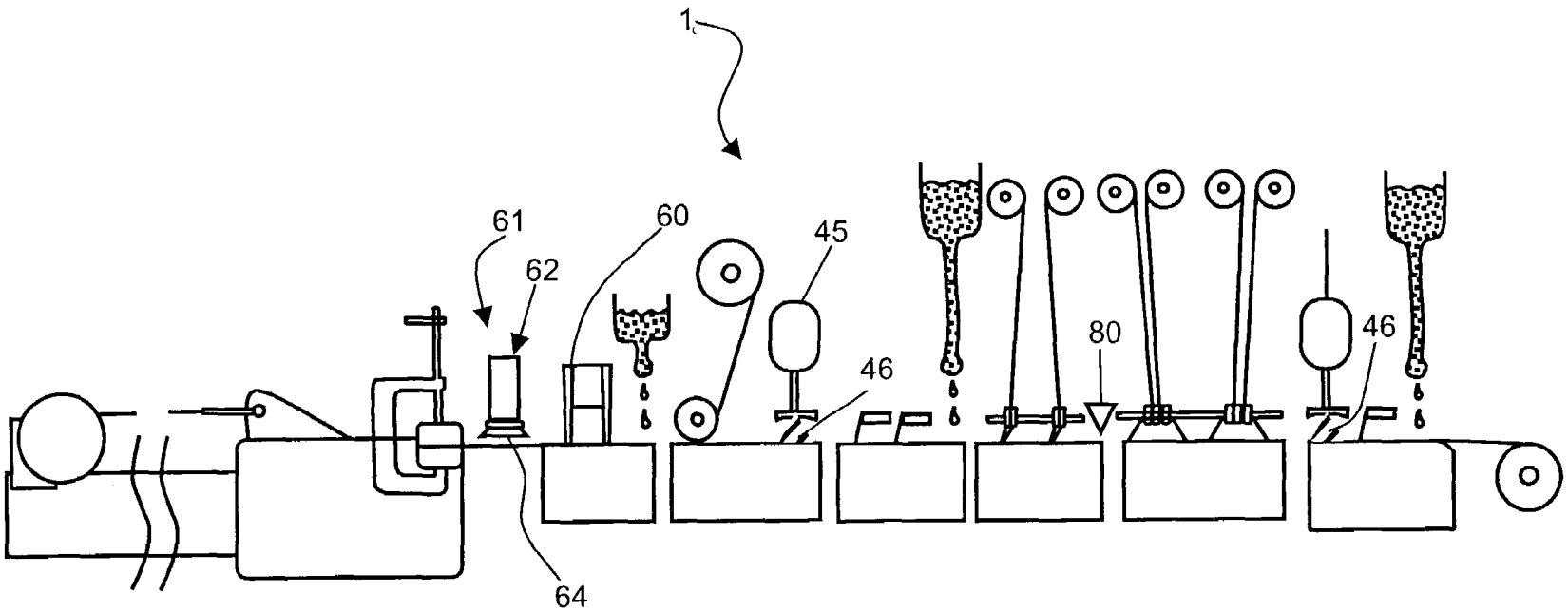
FIG. 18 is a schematic illustration of an exemplary installation in which small fibers are dispersed into the resin coating to provide tear resistance.

Spaced at the far end of the production line from the leading roll stand (unwind) is a clamping and drawing mechanism generally designated by the numeral 20 and shown in detail in FIGS. 6 and 7. This apparatus consists of a lower clamp element 22 which has a surface greater than the width of the sail and a length in the machine direction of approximately three (3) inches and an upper clamp element 24 on top of this surface which, by exerting pressure on the surface below it, holds the leading edge of the carrier film 12 in place. The clamping elements 22, 24 are somewhat flexible over their entire width in that they can assume a curved or convex form over their width. The nature of this arcuate form is controlled by the computer software described previously and in alternate embodiments manually controlled and any combination thereof. This clamping and drawing mechanism 20 includes a set of rails 26 along which the clamps 22, 24 will move as they pull the carrier film 12 from the unwinds 10 in a direction from the roll stand 10 aft to the drawing mechanism 20. The roll stand 10 being oriented generally forward of the apparatus for sail making 1 and the drawing mechanism 20 being oriented generally at an aft location. It is contemplated that the location of various elements of the apparatus for sail making 1 can be varied along the apparatus and the exemplary embodiment illustrated in FIGS. 4 and 18 depict one of many arrangements. The speed of the travel of the clamping mechanism 20 in the machine direction is controlled by the computer software or manually or any combination thereof. The maximum length of its travel coincides with the anticipated tallest sail to be produced by this installation.

Figure 8:
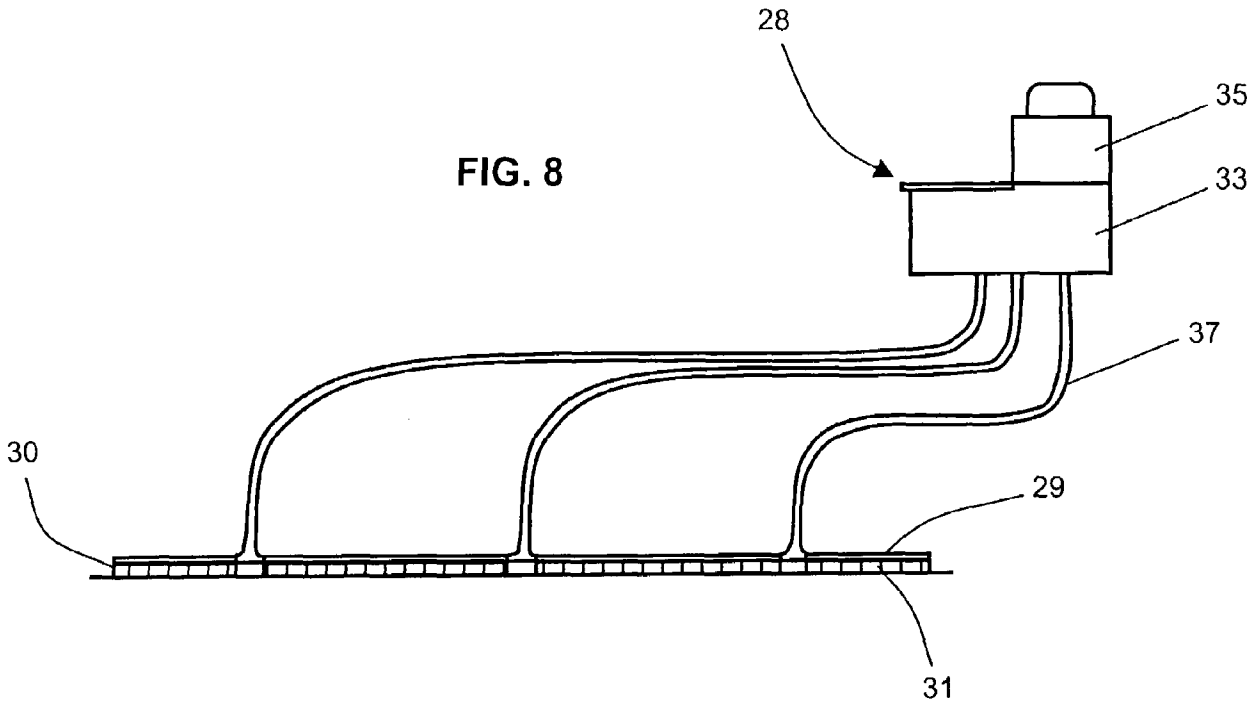
FIG. 8 is a fragmentary front elevational view of an exemplary resin dispensing conduit assembly disposed on a planar support segment.
Figure 9:
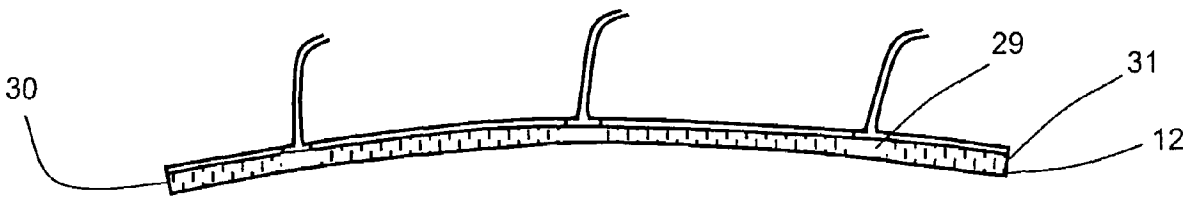
FIG. 9 is a similar view of the conduit flexed arcuately to conform to the curvature of underlying support segment.

As seen in FIGS. 4, 8 and 9, proximate to the unwinds 10, or the first station in the machine direction (i.e., fore to aft), is a resin dispenser 28 having a conduit assembly generally designated by the numeral 29. In an exemplary embodiment the conduit assembly can have a length of thirty-five (35) feet. The flexible conduit 29 has apertures in its lower surface through which the resin is dispensed onto the surface of the carrier 12 to provide a first coating or simply a coating 31. This tubular conduit 29 lies just above the surface of the carrier 12, and the resin is driven through the resin dispenser 28 and conduit assembly 29 fed from the supply 33 by the pumps 35 through the tubes 37. It is also contemplated that alternative elements can provide resin in the process, including manual application, spray jets, and the like. The resin can be provided in amounts regulated by the computer software or manually controlled and applied.

Figure 10:
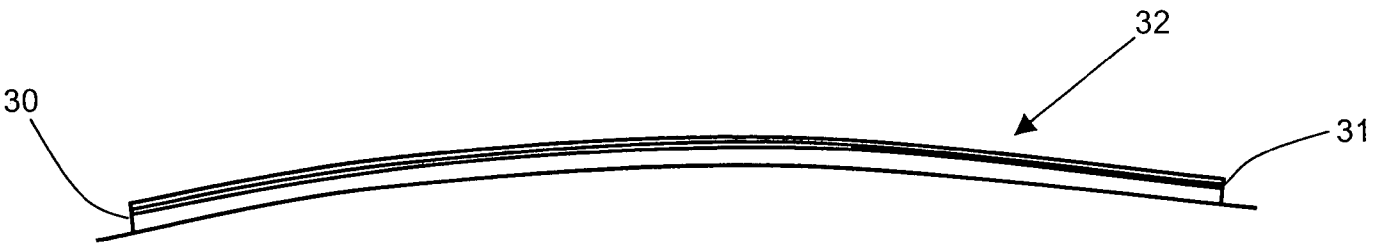
FIG. 10 is a front elevational view of an exemplary flexible wiper flexed to conform to the support segment.
Figure 11:
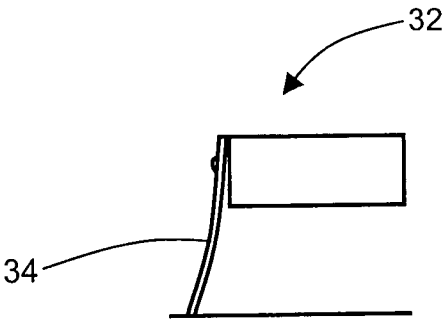
FIG. 11 is a side elevational view showing the wiper drawn to an enlarged scale.

Adjacent to the resin dispenser 28 in the machine direction is a flexible wiper portion seen in FIGS. 10 and 11 generally designated by the numeral 32. In an exemplary embodiment the wiper portion or simply wiper 32 can be thirty-five (35) feet in length and approximately one and one-half (1½) inches high. It is contemplated that the wiper portion 32 can be duplicated into multiple units and can be various lengths depending on the apparatus. The relatively flexible wiper blade 34 smoothes out the resin coating 31 which has been dispensed upon the carrier 12 so that there is an even coating of material. The wiper portion 32 is adjustable and adaptable to the shape of the support mechanism 18 as well as the support surface of the support mechanism 18. The wiper portion 32 is configured to control the amount of resin forming the first coating 31 by smoothing and shaping the resin.

Figure 12:
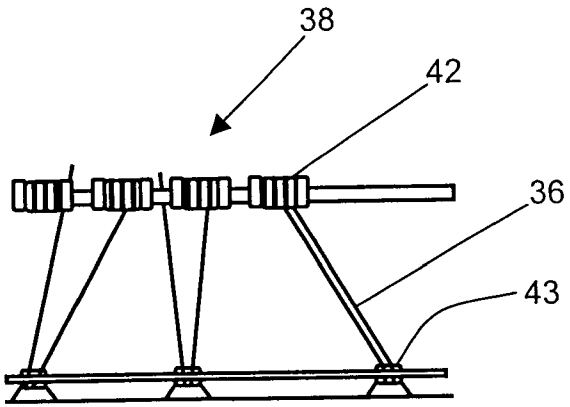
FIG. 12 is a side elevational view of the exemplary reinforcing yarn application devices.
Figure 13:
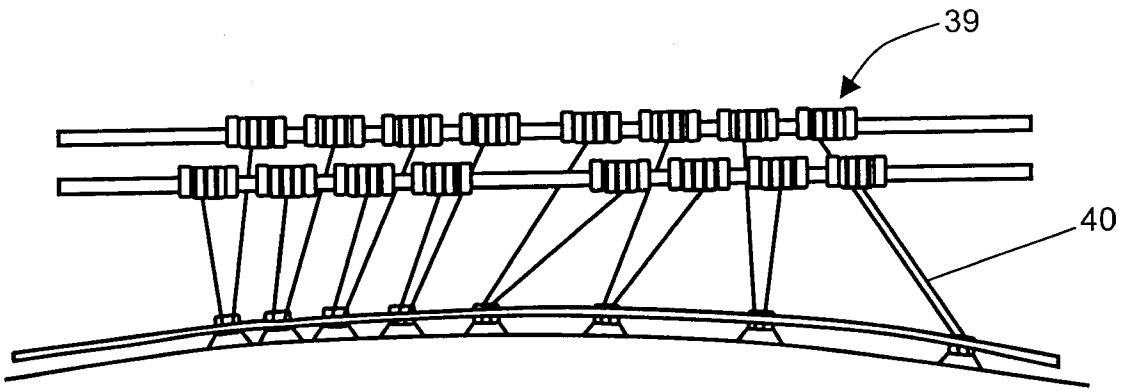
FIG. 13 is a front elevational view of the exemplary structural yarn application devices.
Figure 14:
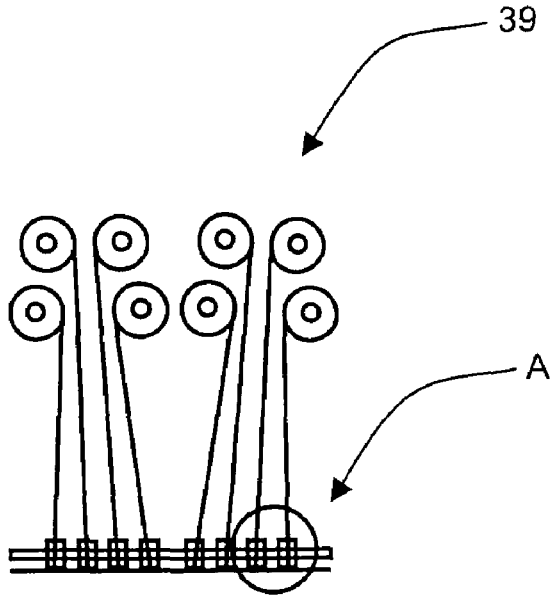
FIG. 14 is a side elevational view of the elements in FIG. 13.
Figure 15:
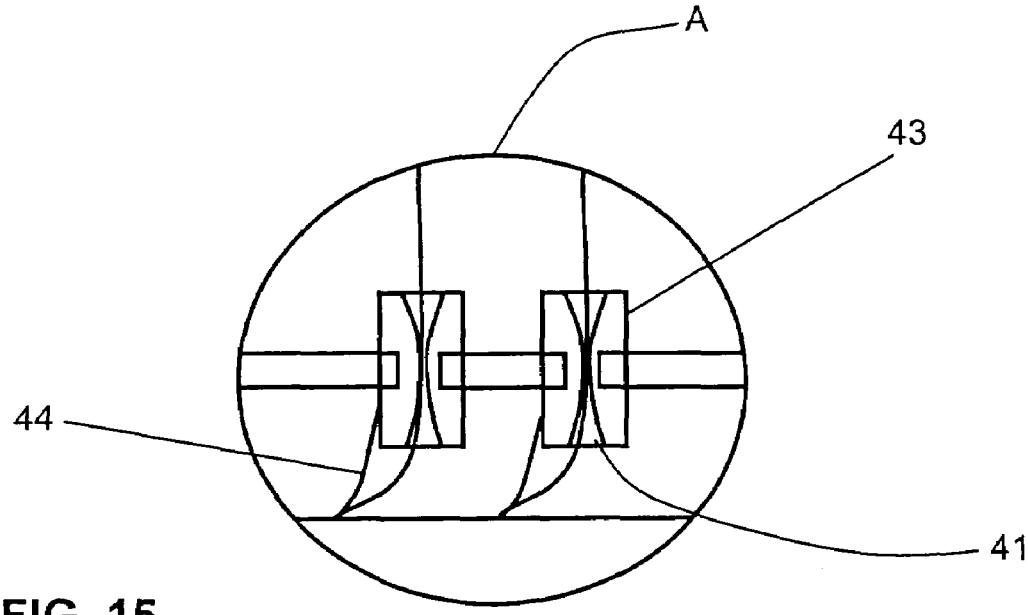
FIG. 15 is an enlarged view thereof showing the exemplary fingers for pressing the yarns into the coating.

As seen in FIGS. 4, 12 and 13, the next station contains a series of computer driven reinforcing yarn applicators or simply yarn applicators 38 that are schematically illustrated. The reinforcing yarns 36 are dispensed onto the coating 31 from rolls 42. The rolls 42 include applicator heads 43. The applicator heads 43 have motors (not shown) to draw the yarns 36 and lay the yarns 36 into the coating 31. The applicators 38 are supported and driven across the machine direction so that they can travel across the film 12 and lay the yarns 36 in a pattern 100, for example shown in FIG. 1 and extending between leech and luff. The yarn applicator 38 can provide an infinite variety of patterns 100 depending on the design required by the sail being produced. In an alternate exemplary embodiment, the resin dispenser 28 and the yarn applicator 38 can be combined such that the yarns 36 are applied to the carrier film 12 with a quantity of resin already applied to the yarns 36. The pre-wetted yarns adhere to the carrier film 12 and/or the coating 31.

Referencing FIGS. 12-15, at the next station is another set of yarn applicators generally designated by the numeral 39 which place the structural primary load bearing or structural yarns 40 upon the carrier 12 and into the resin coating 31. The exact positions of the applied yarns at every moving point on the coated carrier 12 are determined by the software described above and/or manual manipulation of the applicators 39. Each applicator head 43 has a set of orifices 41 through which the yarns 36, 40 are driven by an individual stepping motor (not shown). There is a small flexible wiper 44 adjacent each set of orifices 41 that presses each dispensed yarn into the coating 31 on the carrier film 12.

Some of the structural yarn applicators 39 are movable transversely of the carrier 12 so that, the structural yarns 40 are lain in a direction extending towards the luff edge of the sail as indicated in FIG. 1. It is contemplated that the structural yarns 40 can be laid in any of a variety of directions relative to the edges, foot and head of the sail to form an infinite variety of additional patterns 100.

It will be appreciated that the transverse motion of the applicators 38 back and forth between the luff and leech edges will be relatively rapid. It is also contemplated that the speed of the process can be at lower rates in order to manually apply yarns and other components into the sail casting.

At the next station is a second resin dispenser 48 including a tubular conduit assembly generally designated by the numeral 49. In an exemplary embodiment, the second resin dispenser 48 is essentially identical to the first resin dispenser 28. A second portion of resin is driven through this device in volumes prescribed by the computer software and/or through manual means to provide the desired depth for the coating 31 and to encapsulate the yarns 36, 40, thus forming a second coating 30.

Proximate to the second resin dispenser 48 is a second wiper portion 50 including flexible wipers to smooth the second coating 30. The second wiper portion 50 can be similar to the first wiper portion 32 installed adjacent to the first resin dispenser 33. The second wiper portion 50 is configured to control the amount of resin forming the second coating 30. The first resin dispenser 33 and second resin dispenser 48 can include tubes, open trays, troughs and the like for fluidly controlling the resin.

A top film applicator 51 can be located proximate to the second wiper portion 50. The top film applicator 51 includes a second unwind array 52. The second unwind array 52 can be setup and installed in much the same manner as is the roll stand 10 from which the carrier 12 was supplied. The top film applicator 51 is above the other components and from this unwind array 52 comes the top or cover film 54. In an exemplary embodiment the top film 54 can be identical to the initial (or underside) carrier material 12. The top film applicator includes a roll 56 configured to adjustably press the top film 54 onto the second coating 30. The coated carrier 12 and top cover film 54 are passed under the roll 56 (whose pressure is adjustable) and the top film 54 is pressed onto the upper surface of the second coating 30. The top film 54 has been initially led under the roll 56 along with the carrier film 12 and both are clamped in the clamp assembly 20 so that they move in unison.

Figure 16:
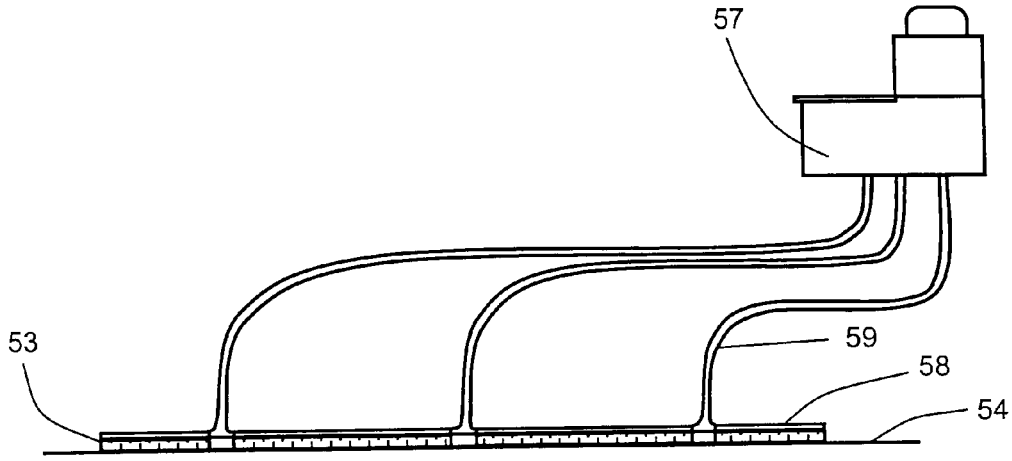
FIG. 16 is a front elevational view of the exemplary oil dispenser with the conduit in an unflexed state.
Figure 17:
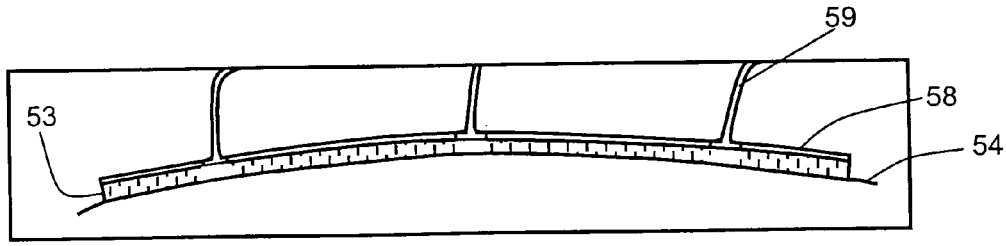
FIG. 17 is a fragmentary view with the conduit flexed to conform to the segment.

In alternative embodiments, after the top film 54 is applied, a very fine coating of lubricant 53 is applied. The lubricant 53 is usually a lubricating oil applied to the upper surface of the top film 54 by a lubricant dispenser 55. As seen in FIGS. 16 and 17 lubricant 53 is pumped from tank 57 through tubes 59 to a flexible conduit 58. In exemplary embodiments, the lubricant 53 lubricates the top film 54 and allows for the top film 54 to pass through the apparatus without being adversely altered or misaligned. It is contemplated that in other embodiments the apparatus does not require the application of the lubricant 53 to the top film 54 due to the nature of the components aft of the top film applicator 51.

A calender 60 is proximate to the top film applicator 51. The assembly of film and resin is passed through the calender 60 that presses, squeegees, or rolls the assembly to the desired thickness and (degases) expels air from the coating 31. The calender 60 is configured to shape and degas the first coating 31 and the second coating 30 between the carrier film 12 and the top film 54. The calender 60 is adaptable to the shape of the support mechanism, as well as the support surface of the support mechanism 18. As the support surface flexes and bows and assumes various arcuate shapes, the calender 60 adapts to those shapes.

An element applicator 80 can be located along the apparatus for making sails 1 between the first resin dispenser 28 and the top film applicator 51. The element applicator 80 is configured to apply additional elements 82 on the coatings 30, 31. The additional elements 82 can include corners, such as tack, clew and head. The additional elements 82 can included reef points, battens, batten pockets stiffeners, grommets, reinforcements, numerals, logos, insignia, signals, and the like. The element applicator 80 can be computer controlled or in other embodiments manually controlled and any combination thereof.

Illustrated in FIG. 18 is a modified installation in which there are optional stations such as a reinforcing fiber applicator 45 having a series of spray heads 46—which spray a predetermined volume of small fibers 47 (nylon, polyester, aramid, or the like), which may range in length from one-half (½) inch to one (1) inch in length, onto and into the smooth coating of resin. The volume of dispensed fibers 47 can be controlled by the software referred to previously as well as manually and any combination thereof. Because the speed of carrier 12 and coating in the machine direction is relatively slow, these fibers 47 can become immersed within the coating 31 as well as remain on its surface. The purpose of these fibers is to provide strong resistance to tear proliferation to the body of the sail.

Following the calendering station 60, the coated carrier assembly is passed through a curing mechanism 61. The curing mechanism 61 or curing station, can have a multiplicity of radiation heads generally designated by the numeral 62 and shields 64 about their lower ends. The resin of the coatings 30,31 is exposed to sufficient radiation for at least substantial, if not complete, curing to set the sail body in its predetermined form the curing mechanism 61 can include a variety of sources of radiation. The radiation sources can include but are not limited to infra red, ultra violet, microwave and electron beams. It is also contemplated that thermal energy in convective and conductive transfer modes can also be employed to cure the resin.

A sail rack mechanism 90 can be employed to maintain the sail in a desirable position for further curing. The sail rack mechanism 90 can be located aft of the curing mechanism 61. The sail rack mechanism 90 can maintain the sail in a position that enhances the foil or sail form as well as provides an environment for proper curing such as temperature, humidity, and air purity. Subsystems that control the environment can be included with the sail rack mechanism 90. In one embodiment, the sail rack mechanism 90 can manipulate the sail such that the weight of the sail due to gravity allows the sail to hang or suspend into the sail form. The sail rack mechanism 90 can remove the sail from the curing mechanism 61 and rotate the sail into position for proper curing and shaping. Other embodiments allow for pressing and contouring the sail in the sail rack mechanism 90 to maintain or create sail form effects.

Figures 19, 20:
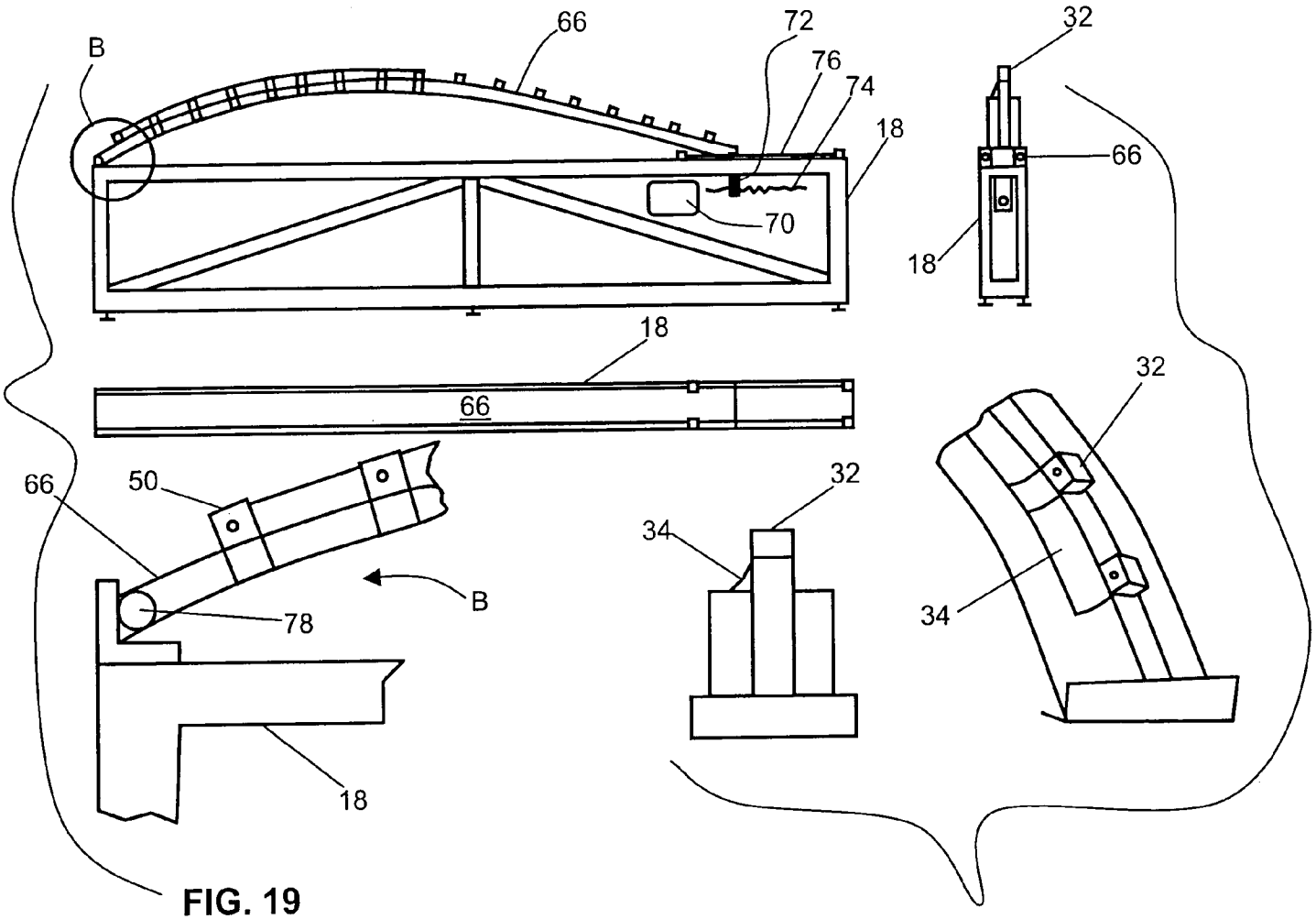
FIG. 19 is a fragmentary view of the support table with a segment in planar position.
FIG. 20 is a similar view with the segment flexed into a convex position.

Referencing FIGS. 19 and 20 the several stations are located along the support member 18 which is driven device to apply the three dimensional component to the sail. The support member 18 is a segmented platform that can be at least thirty-five (35) feet wide in exemplary embodiments, and it is as long as the distance from the first tubular resin dispensing device to the far end of the curing mechanism, and it can extend still further if so desired. This segmented platform is divided into a multiplicity of generally horizontal segments 66. In exemplary embodiments each segment 66 can be thirty-five (35) feet in the transverse direction and 0.3-1.5 feet in the machine direction. As described in detail hereinafter, these segments 66 may be flexed in the transverse direction to provide the curvature for the sail body and sail form along its length as controlled by the computer and/or manual manipulation and any combination thereof.

Each segment 66 assumes the exact definition of the predetermined three dimensional sail as specific sections of the carrier 12 pass over it. It is the convex attitude which the sections of this platform take which renders a three dimensional component to the end product which is the sail as a whole. As the carrier film 12 and initial plastic resin coating 31, and then the upper and lower films 12, 54 and the full plastic resin coating 31 which resides between the films, pass over the sections of this platform in the machine direction, the computer software can regulate the required definition of the convexity of the segments 66 of the platform or support. Therefore, exactly with the amount of three dimensional component called for at arbitrarily established measurement stations, which are set by the software or by manual determinations. The amount of overlap along the edges of each section of, first the lower and then the upper and lower films 12, 54 change as the passage over the platform or support 18 introduces the three dimensional component to the films and resin.

As an example, one section of the platform, when a measurement point at twenty-five (25) percent of the distance from foot to head passes over it, will automatically assume the three dimensional definition which is called for at this exact twenty-five (25) percent point by the software. Because the carrier is always moving in the machine direction, the convexity of segments 66 of the platform is always changing. Forward motion in the machine direction and arching and flattening movement of the segments 66 of the platform are maintained in absolute concert by the software.

After the top film 54 has been applied over the coating 31, the lubricating oil sprayed or flowed thereon acts as a lubricant to minimize friction as the calenders 60 bear thereon. To apply controlled down pressure springs or air cylinders may be employed to urge the calenders 60 against the top film 54, and the calenders 60 have the same curvature as the underlying segment 66.

Immediately upon exiting the calendering mechanism 60, the assembly of the carriers with the resin and fibers therebetween passes through the curing station 61 to effect at least partial curing of the coating in the contours which have been generated therein by the movable segments 66 of the platform 18. The curing produced by the curing station 61 is regulated by the software which will regulate the radiation commensurate with the speed of the assembly therethrough.

If the curing is complete, after the head, of the sail has cleared the curing mechanism, the forward motion of carrier and resin may stop. The top film 54 is removed, and the completed sail body is removed from the carrier film 12.

If small fibers are desired in the sail body, it is anticipated that it may, as production experience is gained, be advantageous to preliminary mix very small fibers with the resin and to dispense the two simultaneously. However, the preferred procedure utilizes transverse reinforcing yarns, which can replace the small fibers for providing tear resistance.

Figure 21:
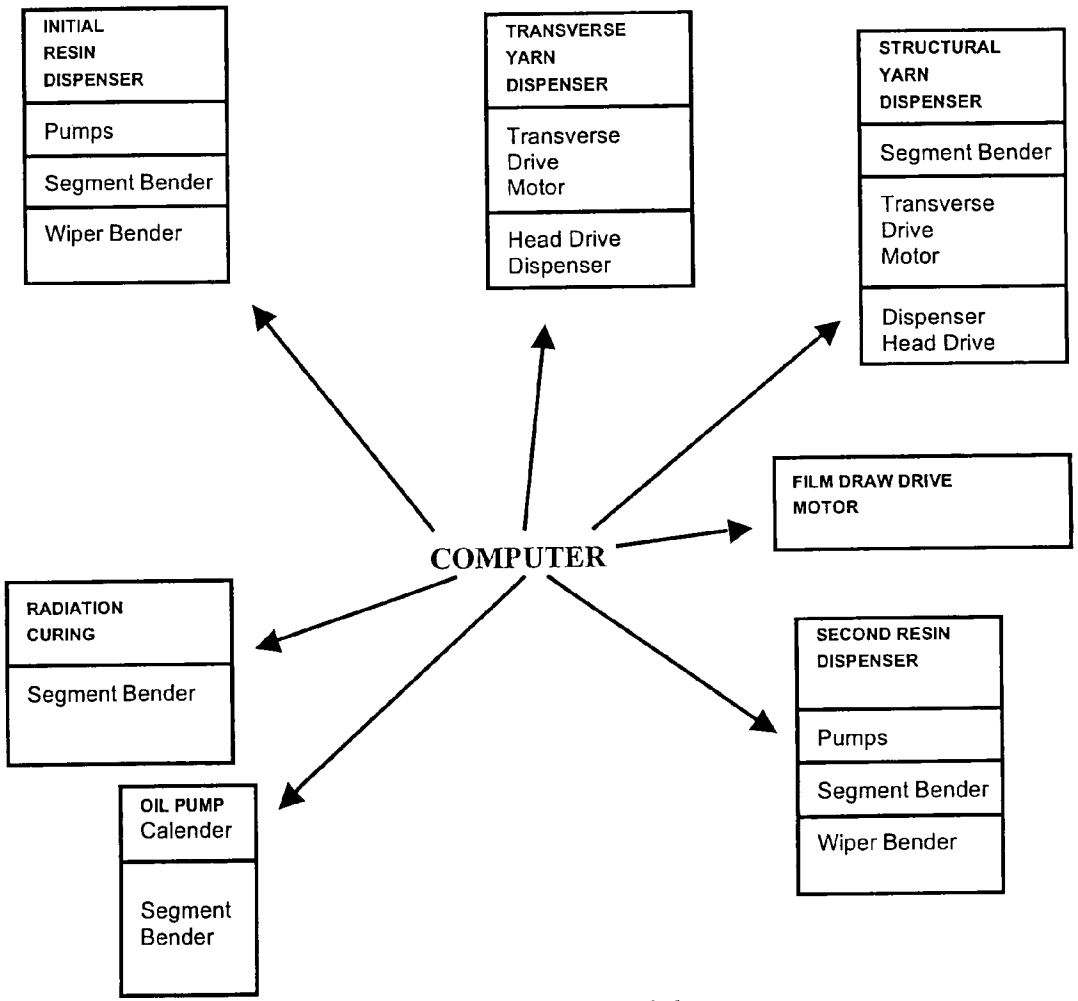
FIG. 21 is a flow chart showing the computer control of the various motors, pumps, valves and radiation sources.

As will be readily appreciated, the various motors, pumps, valves and other operable components are controlled by the computer as schematically illustrated in FIG. 21. In alternate exemplary embodiments, sections of the system can be manually controlled as well as in combination with the computer.

The carrier film and top film utilized in the present application are made of a resin providing a high degree of flexure and strength, and of a chemistry to which the resin coating will not adhere. Polyesters have been found highly suitable and polyethylene terephthalate film having a thickness of 0.003-0.005 inch is conveniently utilized. The rolls of film are preferably on the order of 5-7 feet in width so as to minimize the number of strips of film that must be fed onto the support and drawn along the length thereof.

The resin utilized for forming the coating and, ultimately the body of the sail, should be one which produces a film which is highly flexible, durable, and resistant to ultraviolet ray degradation. Flexible polyurethanes are considered to have optimum properties for this application.

The thickness of the resin coating will depend upon the desired thickness for the sail which, in turn, will depend upon the size of the sail and the forces to which it will be subjected. For a sail to endure fluttering in high wind loads generally some increase in thickness of the sail may be needed, although the structural yarns carry the bulk of the load. Generally, the sail thickness will vary within the range of from about 0.005 of an inch to about 0.080 of an inch, with from about 0.010 of and inch to about 0.200 of an inch being preferred for cruising sails.

The reinforcing yarns are preferably a high modulus polyester which is untwisted and having a generally flat configuration within the range of 1000-2000 denier. A polyester yarn which is presently considered to be highly satisfactory is that offered for sale by Acordis Industrial Fiber, Inc., under the designation Diolen 1100174S2200.

The structural yarns are also a high modulus material having a flat configuration and untwisted, and preferably within the range of 2200-5000 denier. Illustrative of suitable materials are those sold under the mark VECTRAN and designated 1500/300 by Celanese Advanced Materials, which is described as a liquid crystal polymer yarn. Another suitable resin fiber is an aramid fiber sold by Teijin Twaron USA, Inc. under the designation 2200 and aramid fiber sold by DuPont under the trademark KEVLAR.

As seen in FIGS. 19 and 20, the flexible members or simply segments 66 of the support mechanism 18 are individually adjustable to the desired convex curve by actuation of the motor 70 at one end of the segment while the other end is fixed in position. The motor 70 drives a gear assembly 72, which moves the clamp in which the movable end is secured. The support mechanism 18 can include a first side and a second side configured to flex the flexible members 66 to form a shape for the support surface. A load screw 74 interfaces the motor drive gear assembly 72 along a bearing 76. A circular bearing element 78 such as a dowel is insertable at each end of the segments 66 to provide a rotary bearing allowing the segments to adjust without binding. One of the first side and the second side can be movable while the other side is fixed. Moving the movable end towards the fixed end causes the segment 66 to arch upwardly to provide a convexly curved surface over which the carrier 12 is draped. This curve will be varied to conform to the curvature (or lack thereof) for the portion of the sail being generated as it passes thereover.

The elongated segments 66 are flexible and are conveniently fabricated from glass reinforced epoxy resin in a width of 0.4-1.5 feet, and a thickness of about ¼ inch. They can be of uniform cross section over their length or modified at selected portions along the length thereof to facilitate the forming of the desired curvature in that portion of the carrier and coating passing thereover.

Moreover, depending upon the sail dimensions and configuration, the segments may be readily changed to vary the flexural characteristics.

The wipers 32, 50 are conveniently fabricated from a flexible resin formulation such as glass reinforced epoxy or thermoplastic and may be provided with a release coating to minimize adhesion of the liquid resin thereto. They desirably have from about 0.005 to about 0.015 of an inch cross-section and a width of ½-1 inch and a height of ½-1 inch. One end is fixed and the other end is movable by a drive system similar to that for the segments of the support. The drive motor is operated to cause the wiper to assume the same curvature (or lack thereof) as that of the segment with which it is associated.

The calendering station similarly uses two or more spaced elongated flexible members of generally rectangular cross section fabricated of glass filled epoxy resin or thermoplastic and having a thickness of 1/16-3/16 inch. They too may have a release coating thereon. These members are supported and flexed in the same manner as the segments and wipers, and the computer generates the same curvature as that of the support segment therebelow. In addition, solenoid, springs or air cylinders disposed thereabove apply a downward force of about 3-15 pounds per square inch to provide the squeegee action upon the coating disposed between the carrier and top films.

The yarn wipers affixed to the yarn applicator heads are conveniently fabricated from glass reinforced epoxy resin with a channel in which the yarn travels and a length of about ½-1½ inch. As can be seen in FIG. 1, they are angularly oriented in the trailing direction so that the web of the wiper will pass over the yarn and press it into the coating.

The depth of the initial coating will normally be about 40-60 percent of the total thickness. For lightweight sails, the higher end of this percentage will be preferred to provide sufficient depth to allow the yarns being applied to be "fixed" in position by the resin.

The dispensing conduits for the resin are flexible and have apertures therein which are dimensioned relative to the supply point to deliver equal volumes of resin along the length of that portion which is being utilized at any given point along the altitude of the sail being fabricated. Conveniently, the resin supply tubes are connected to the conduit at 1-3 foot intervals and the apertures are spaced at intervals of about 3-6 inches.

The flow of resin through the supply tubes is controlled by the pumps and valves which can be opened or closed by the computer software depending upon the width of the coating required at any given point of the sail altitude and are changing dynamically as the carrier film passes thereunder.

Since the conduit should be located adjacent the surface of the carrier film, the conduit is fabricated of a flexible material such as glass filled epoxy and is flexed in the same manner and to the same configuration as the segments therebelow.

Various energy sources may be used to effect curing of the resin depending upon the resin system selected, including infrared radiation, ultraviolet radiation, microwave radiation and electron beams. Gas/electric heaters may also be used for heat curing systems. With the preferred urethane resins and catalysts employed therewith, ultraviolet radiation is preferable. The resin coatings are relatively thin and the top film is transparent to the radiation so that curing throughout the coating can be quickly effected.

As the initial foot portion of the sail moves through the several stations, the width of the coating and the area in which yarns are applied is decreasing under computer control. The computer thus reduces the section of the resin conduits delivering rein for the coating as well as the number and location of yarn applicators.

If less than the full width of the support surface is to be used for making smaller sails, the operative portions of the several stations are centered on the midpoint of the width of the support. The number of film feed rolls is limited to that required for the maximum width of the sail, and the resin feed to the dispensing conduits is limited. The yarn applicators actuated are those in the sail area then being formed.

Following the trimming of the sail body, various finishing operations may be conducted in a conventional manner. For large head sails, it may be desirable to bond a reinforcing panel across the foot of the sail, and this panel should include structural yarns extending between the clew and tack. The resin employed for this foot panel is desirably the same as that used for the sail body and any compatible adhesive may be used to effect the bonding.

Other elements which are bonded to the sail body are pulpit patches, clew and tack reinforcing patches and rings, spreader patches, batten pockets, head plates and patches, reefing tapes and grommets, etc. The resin employed for the patches and tapes is preferably the same as employed for the sail body.

The computer software takes the designer s input as to the type of sail (head or main), maximum operating wind velocity, operative dimensions, camber and draft, and desired thickness and then calculates the convexity at various points along the altitude of the sail and the number land placement of the structural yarns. Based upon this input, the computer controls the pumps for the resin, the motors to flex the support segments, wipers, conduits and calenders, and the motors feeding the yarn applicator heads to make the changes necessary for those operative elements of the installation as the carrier and coating move into alignment therewith.

In a general sense, the novel process described herein is motion intensive and yields the complete seamless body of a sail. All that is required at the end of the forming steps of the process is, perhaps and depending upon exactly what specific polymer is used, a further curing stage. The essence of this process is motion itself, since the elements characterizing the essence and detail of the sail—its form and its structural and reinforcing components providing its internal structure, and its skin, are incorporated contemporaneously.

Throughout the process, as the carrier and resin move in the machine direction, they are moving across segments of what is called a support table. As indicated previously, each segment of that support table is automatically set by a computer driven mechanism to exactly that form required by the portion of the sail which is moving over it at any given moment. Alternatively, the table can be manually set. Viewed in the machine direction, the motion of the segments of the support table resembles that of a wave. As the portion of the carrier and coating representing the sail s lowest transverse section (foot) moves from the first table segment to the second, the first table segment automatically assumes the form of the sail s next to the lowest transverse segment, and so on until carrier and sail have completely passed the forming table s last segment. It can be said, therefore, that it is the essentially continuous and multifaceted motion during the application of materials within the realm of this motion that enables the efficient and extremely high quality formation of the sail body.

Figure 22:
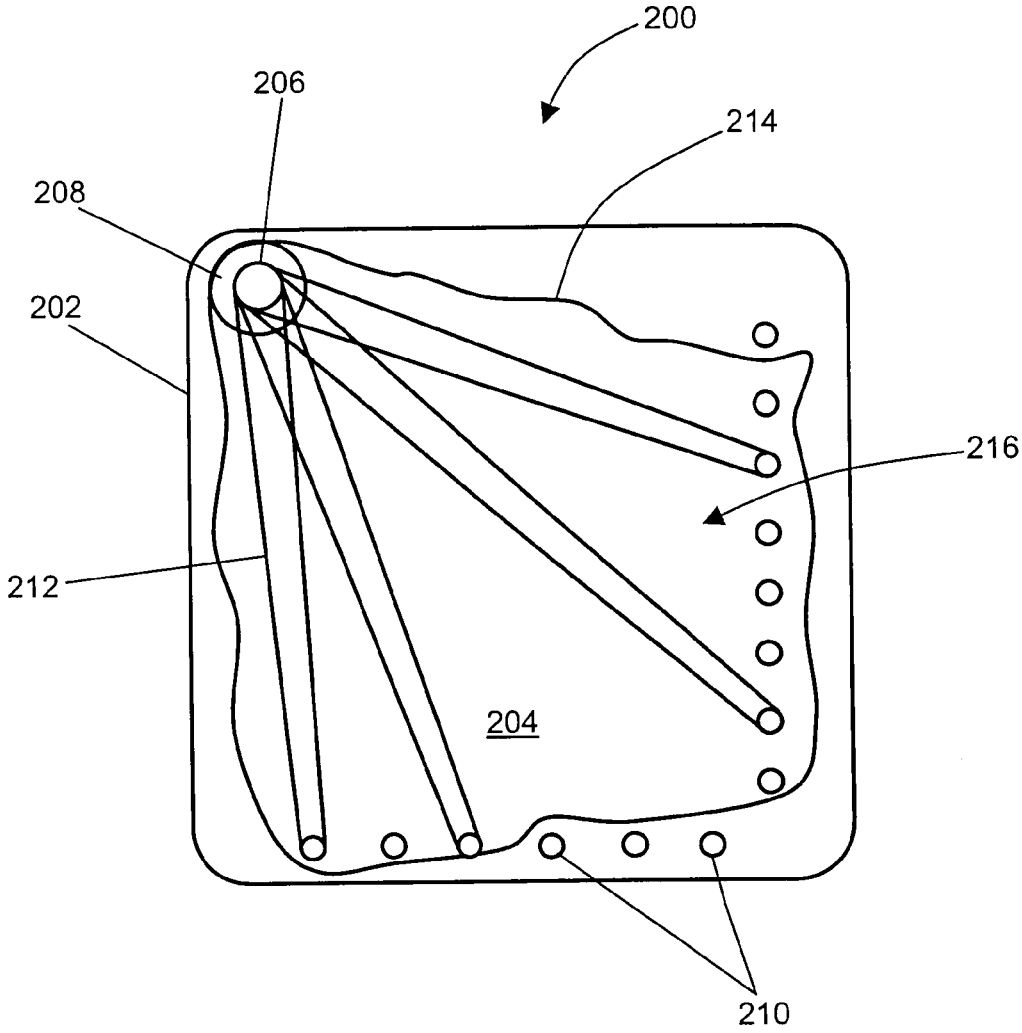
FIG. 22 is a schematic of an exemplary corner jig.

Referring now to FIG. 22 an exemplary corner jig is illustrated. The extremities of the sail are attachable to rigging and tackle of a sailing vessel that supports the sail. The head, the clew and the tack all tie into the sailing tackle of the sailing vessel. The extremities are exposed to high stresses and require reinforcement. Reinforced areas of the sail known as corners are employed in the sail structure in order to withstand the high stresses. The corners can be fabricated outside of the sail casting apparatus. The construction of the corners can be done with a corner jig 200. The corner jig includes a body 202 having a first side 204. A land 206 is formed on the body 202 at the first side 204. The land supports a hard point or tie point or grommet 208. The grommet is the focal point of the stress and acts to facilitate the tie-in of the sailing tackle and lines that attach the sail to the sailing tackle. Leads 210 are formed on the body 202 on the first side 204 distal from the land 206. In an exemplary embodiment, the leads 210 are located along orthogonal lines proximate a perimeter of the body 202. The leads 210 maintain a plurality of points to anchor yarns or structural members 212 that are used to reinforce and form the corner. The leads 210 can be located to facilitate weaving or intertwining a pattern of the structural members 212 onto corner jig 200 to form the corner. A resin 214 can be poured over the body 202 and commingle with the structural members 212 and grommet 208. Multiple layers of resin 214 and Structural members 212 can be employed to reinforce and form the corner. A cover film (not shown) can be applied over the resin 214 and structural members 212 to facilitate degassing, such as by pressing the resins under the cover film. Responsive to the resin 214 curing at least partially, the now formed corner 216 can be removed from the, corner jig 200 and placed to cure or have further resin 214 applications and trimming processes conducted.

Illustrative of the disclosure is the following example.

EXAMPLE

A sail designer provides the following data for a 150% Genoa jib for a 35 foot cruising sailboat.

The dimension of the Finished Leading Edge Length—(approximately 49.0).

The dimension of the sail plan s Foretriangle Base—(15.5).

The Finished Leading Edge Perpendicular expressed as percentage of the sail plan s Foretriangle Base—(150%).

The height of this sail is then 49.0 and its approximate width is 22.5.

This information is entered into the computer.

Using a casting installation substantially as shown in FIG. 4, the unwind apparatus is configured to feed 5 foot wide polyester film from 5 roll stands with an overlap of 3 inches. Polyurethane resin is employed for the coating, specifically a resin formulation sold by PTM&W Industries, Inc. of Santa Spring, Calif. under No. PR7660.

The ends of the carrier film are clamped in the puller device. Resin is deposited on the carrier to a depth of 1/32-3/32 inch and transversely over the overlapping films for 22.5 feet representing the foot of the sail as the film is being drawn at a rate of 10 feet per minute. Untwisted polyester yarns Acordis diolin type 174S1,100 Dtex are deposited generally transversely across the foot portion and thence diagonally between leech and luff throughout the sail.

Structural yarns Teijin twaron aramid filament yarn type 2200, 3220 DTEX and 2420 DTEX, and Celanese Vectran type HS2250 denier 450 filament count are thereafter laid over the reinforcing yarns starting at the clew and extending to the luff edge and to the head of the sail, in a pattern similar to that seen in FIG. 1.

After the application of the structural yarns, additional resin is deposited to provide a coating depth of from about 0.005 to about 0.015 of an inch and to completely encapsulate the yarn. The coating is then wiped to smooth the surface, and polyester film is drawn over the coating and pressed thereonto to provide a top film.

This film assembly is then passed under a light oil dispenser and then a pair of calendering blades to smooth the resin layer and expel air therefrom. The film assembly then passes under an array of UV lamps to effectuate curing of the resin.

Following the irradiation, the assembly is moved onto a planar support where the resin is allowed to cure completely for 5 hours. The carrier and top films are stripped from the sail body, which is found to have smooth surfaces with the yarns completely encapsulated therein.

The sail body is then moved to a finishing station for farther processing.

Thus, it can be seen from the foregoing detailed specification and attached drawings that a durable and attractive sail with a seamless body can be produced quickly and economically. The sail is resistant to tearing and able to withstand high tensile loads. It is an advantage to provide a novel method for the casting of a seamless sail in one piece.

An advantage of the disclosed method is that reinforcing yarns or fibers are readily disposed in a matrix of resin to provide substantially smooth surface skins.

Another advantage of is that the method reliably produces reinforced sails with desirable characteristics and at reasonable cost.

Yet another advantage is providing novel apparatus for casting such sails and which is readily configurable for sails of different contours and sizes.

A further advantage is providing novel unitary cast sails with reinforcing fibers or yarns disposed within a resin matrix and in which the skin surfaces are smooth.

What is claimed is:

1. A method of casting a sail comprising:
supplying a carrier film;
supporting said carrier film along a support mechanism;
forming a sail form with said support mechanism;
pulling said carrier film across said support mechanism;
dispensing a resin onto said carrier film to form a first coating;
wiping said resin to control the amount of resin for forming said first coating;
applying at least one yarn on said first coating in at least one first pattern;
applying at least one yarn on said first coating in at least one second pattern;
dispensing a resin onto said carrier film to form a second coating covering at least one of said first pattern and said second pattern;
wiping said resin to control the amount of resin for forming said second coating;
applying at least one of a tack, a clew and a head corner to the at least one of said first coating and said second coating;
applying a top film on said second coating after applying the at least one of a tack, a clew and a head corner to the at least one of said first coating and said second coating;
calendering said first coating and said second coating; and
curing said resin of said first coating and said second coating.

2. The method of claim 1 further comprising:
applying a lubricant to said top film.

3. The method of clam 1 further comprising:
adjusting said support mechanism to shape said sail form.

4. The method of claim 1 further comprising:
controlling at least one of pulling said carrier film, forming said sail form, dispensing said resins, applying said yarns and curing said resins with a computer controller.

5. The method of claim 1 further comprising:
applying reinforcing fibers to at least one of said first coating and said second coating.

6. The method of claim 1 further comprising:
racking the sail on a sail rack to maintain said sail form.

7. The method of claim 1 wherein supplying a carrier film includes supplying a plurality of carrier films in an overlapping pattern over the support mechanism.

8. The method of claim 1 wherein forming said sail form with said support mechanism includes adjusting a support surface of said support mechanism.

9. The method of claim 1 wherein pulling said carrier film includes varying the rate of pull of said carrier film.

10. The method of claim 1 wherein dispensing a resin onto said carrier film includes spraying said resin on said carrier film.

11. The method of claim 1 wherein applying at least on yarn on said first coating in at least one first pattern includes a plurality of applicator heads.

12. The method of claim 1 wherein pulling said carrier film across said support mechanism includes shifting said carrier film on said support surface in multiple orientations.

13. The method of claim 1 wherein calendering said first coating and said second coating includes pressing said first coating and said second coating to a determined thickness.

14. The method of claim 1 wherein curing said resin of said first coating and said second coating includes partially curing said resin of said first coating and said second coating.

15. The method of claim 1 wherein applying at least one of a tack, a clew and a head to at least one of said first coating and said second coating is applied to the first coating and in between the first and second patterns.

16. The method of claim 1 further comprising applying at least one additional element to at least one of said first coating and said second coating before applying the top film, wherein the at least one additional element is selected from the group consisting of a reef point, a batten, a batten pocket, a grommet, a numeral, a logo and an insignia.

17. A method of casting a sail comprising:

supplying a carrier film;

supporting said carrier film along a support mechanism;

forming a sail form with said support mechanism;

pulling said carrier film across said support mechanism;

dispensing a resin onto said carrier film to form a first coating;

wiping said resin to control the amount of resin for forming said first coating;

applying at least one yarn on said first coating in at least one first pattern;

applying at least one yarn on said first coating in at least one second pattern;

dispensing a resin onto said carrier film to form a second coating covering at least one of said first pattern and said second pattern;

wiping said resin to control the amount of resin for forming said second coating;

applying at least one additional element to the at least one of said first pattern and said second pattern, wherein the at least one additional element is selected from the group consisting of a, tack, a clew, a head, a reef point, a batten, a batten pocket, a grommet, a numeral, a logo and an insignia;

applying a top film on said second coating after applying at least one additional element to the at least one of said first pattern and said second pattern;

calendering said first coating and said second coating; and curing said resin of said first coating and said second coating.

18. The method of claim 17 further comprising:

applying a lubricant to said top film.

19. The method of clam 17 further comprising:

adjusting said support mechanism to shape said sail form.

20. The method of claim 17 further comprising:

controlling at least one of pulling said carrier film, forming said sail form, dispensing said resins, applying said yarns and curing said resins with a computer controller.

21. The method of claim 17 wherein supplying a carrier film includes supplying a plurality of carrier films in an overlapping pattern over the support mechanism.

22. The method of claim 17 wherein pulling said carrier film includes varying the rate of pull of said carrier film.

23. The method of claim 17 wherein pulling said carrier film across said support mechanism includes shifting said carrier film on said support surface in multiple orientations.

* * * * *